United States Patent [19]

Cavagna

[11] Patent Number: 4,934,234

[45] Date of Patent: Jun. 19, 1990

[54] CONTROL UNIT OF THE BIDIRECTIONAL TRAVERSE OF THE CUTTING MEMBERS IN A MACHINE TO CUT MATERIAL IN SHEET

[76] Inventor: Elio Cavagna, P.za Piemonte, 5 - 20070 Melegnano (Milano), Italy

[21] Appl. No.: 260,735

[22] Filed: Oct. 21, 1988

[30] Foreign Application Priority Data

Oct. 23, 1987 [IT] Italy ..... 22403 A/87

[51] Int. Cl.[5] ..... B26D 1/24

[52] U.S. Cl. ..... 83/498; 83/425.4; 83/504

[58] Field of Search ..... 83/498, 499, 504, 508.2, 83/508.3, 425.4, 506

[56] References Cited

U.S. PATENT DOCUMENTS

| | | | |
|---|---|---|---|
| 1,968,865 | 8/1934 | Yoder | 83/499 |
| 3,422,714 | 1/1969 | Van Gompel et al. | 83/498 |
| 3,886,833 | 6/1975 | Gunn et al. | 83/499 |
| 4,188,846 | 2/1980 | Jones et al. | 83/499 |
| 4,320,677 | 3/1982 | Tahara | 83/499 |
| 4,516,454 | 5/1985 | Mosburger | 83/499 |
| 4,633,747 | 1/1987 | Primich | 83/499 |
| 4,649,782 | 3/1987 | Cavagna | 83/499 |
| 4,684,360 | 8/1987 | Tokuno et al. | 83/498 |
| 4,708,009 | 11/1987 | Post | 83/499 |

*Primary Examiner*—Frank T. Yost
*Assistant Examiner*—Scott A. Smith
*Attorney, Agent, or Firm*—Bucknam and Archer

[57] ABSTRACT

Control unit to obtain bidirectional transverse of the cutters in a machine for the parting and/or cutting of a material in sheets, preferably of the paper type, to obtain reciprocal positioning of the knife and counterknife required for cutting. The control unit according to the invention comprises a pneumatic system to drive the machine which once activated, determines the coupling of the support of the knife and counterknife to a worm screw in rotation which causes horizontal bidirectional transverse of the support.

3 Claims, 2 Drawing Sheets

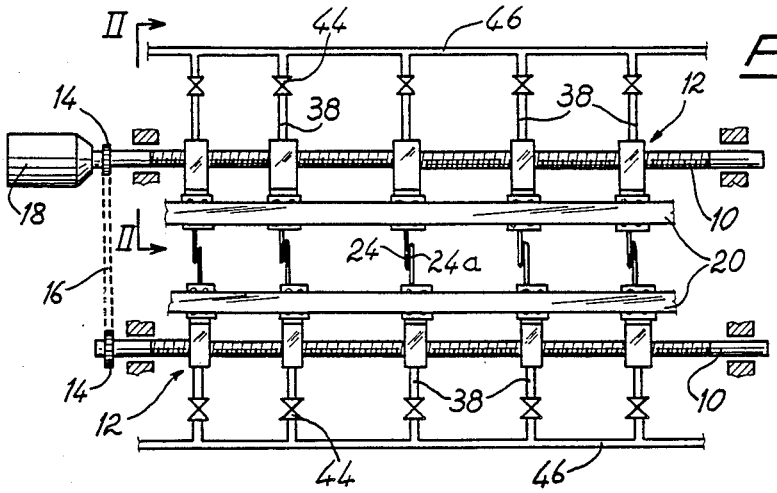
Fig. 1
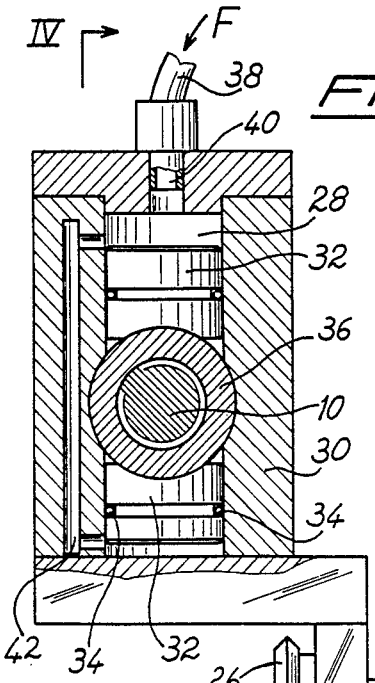
Fig. 2
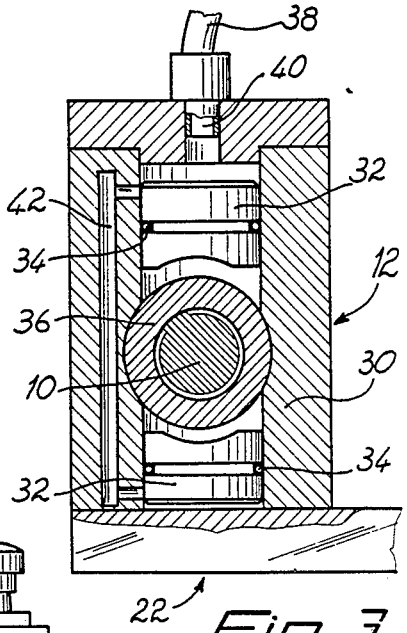
Fig. 3
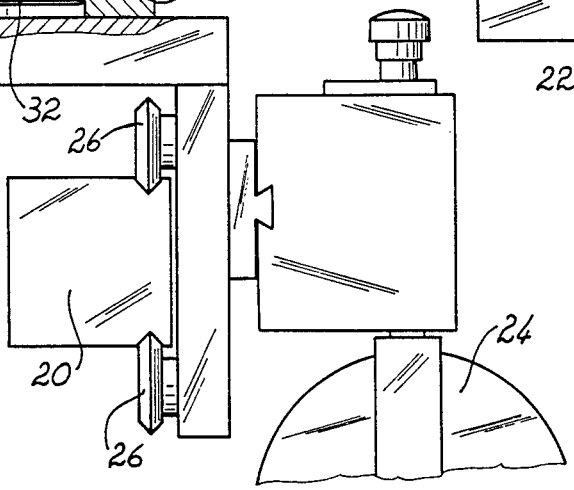

CONTROL UNIT OF THE BIDIRECTIONAL TRAVERSE OF THE CUTTING MEMBERS IN A MACHINE TO CUT MATERIAL IN SHEET

The present invention refers to a control unit of the bidirectional transverse of the cutting members of a machine to cut material in sheet.

In more particular, the present invention relates to a control unit, associable to the knife and counterknife of a machine for the cutting of material in sheets, preferably paper, which makes it possible to make the reciprocal positioning of the knife and counterknife so that they can make a correct cut of the abovementioned material.

In the machines designed to cut material in sheet, preferably paper, knives and counterknives cooperating in pairs are generally used, the reciprocal position of which makes it possible to make the cut of the abovementioned material along prefixed lines.

The problem in this type of machines was to construct control units suitable to carry out a correct movement of the knives and counterknives, to position them at a reciprocal distance which permits the material to be cut precisely and perfectly without burrs. To achieve this, positioning of the knives and counterknives was carried out in various ways. A first known way of positioning the knives and counterknives consists in providing each of the cutting members with autonomous means of control of their movements. This solution, even if technically valid, is, in practice, extremely complicated and expensive because it is difficult to organize the high number of supply cables, and due to the high number of motors associated to each control unit.

A further known system to position the cutting members consists of means of friction placed between the cutting members and the feed means.

Once again, however, a complicated, expensive, technically unsatisfactory structure is obtained. In fact, the friction coupling is not always reliable due, in particular, to the wear deriving from numerous operations required in time. Furthermore, the plurality of friction means necessary for each machine needs complex control members, generally of electronic type, the cost of which affects that of the machine. To solve the above problems, a device has been proposed for the selective or simultaneous transverse of the positioning of the cutting members, which eliminates the complexity of the traditional machines and the consequent excessive cost of same, and their precarious reliability in the positioning of the various control units. This known device essentially comprises substantially bar-formed elements placed in rotation which are coupled to means associated to the knife and counterknife, which transform the movement of rotation into a movement of transverse of the knife and/or counterknife along the respective supporting beams.

These noted means to transform the rotating movement of the bar-formed elements into movement of transverse in each cutting member, comprise:

a series of connecting means, corresponding to the number of cutting members, keyed and torsionally fixed on each bar-formed element;

a substantially cylindrical structure fixed to each cutting member, in which a small shaft is inserted, equipped at one end with a pinion engaged in a rack obtained on the supporting and slip beam of the cutting members, and two bushes inserted along the axis of the small shaft, one of them being axially stationary and free to rotate around the small shaft and equipped with means engaged at right angle with one of the connecting means, and the other torsionally fixed bush being axially mobile with respect to the first bush and moving axially, determining a torsional tie or clearance between the two bushes.

This device for the selective or simultaneous transverse of the positioning of the cutting members is object of a previous patent application, in the name of the same applicant, not yet public.

This device was particularly reliable, simple to operate and suitable to make a precise, correct positioning of the knives with respect to the counterknives.

The object of the present invention is to improve the control unit of bidirectional transverse of the cutting members. According to the present invention, this and other objects which will result from the following description are obtained by means of a control unit comprising a rotating screw associated and parallel to each supporting and slip beam of the means of support of each cutting member; a nut screw or rotating female screw, inside which the screw rotates; and means to stop rotation of the female screw so that the rotation of the abovementioned screw causes a forward or backward movement of the means of support of each cutting member, integral to said control unit.

Preferably, the stop means comprise, on each side of the nut screw, an essentially cylindrical body which is engaged with the nut screw to control the stop in rotations.

Alternatively, the stop means can be a pneumatic piston contrasted by a spring and provided at the end with a stop tooth which is engaged in a corresponding hollow of the nut or female screw.

The constructive and operating characteristics of the control unit of the present invention can be better understood from the following detailed description in which reference is made to the attached drawings which show a preferred, illustrative but non-limiting implementation of the present invention, and in which:

FIG. 1 shows the schematic front view of a machine for the cutting and/or parting of material in sheets, provided with the control units object of the present invention;

FIG. 2 shows the schematic view of a control unit according to section II—II of FIG. 1 in the activation condition in which this unit determines the movement of the knife or counterknife;

FIG. 3 shows the similar schematic view to FIG. 2, with the same control unit in deactivation position in which the knife or counterknife are stationary;

FIG. 4 shows the schematic view of the control unit according to section IV—IV of FIG. 2;

FIG. 5 shows the schematic view of a constructive variation of the control unit, always seen according to a section similar to the section II—II of FIG. 1.

Reference will first be made to FIG. 1 to describe in greater detail, as a whole, the structure of the machine equipped with the control units according to the invention. With reference to the above figure, the machine for the parting and/or cutting of material in sheets comprises a pair of screws (10), parallel to each other, one of them placed in the upper part of the machine, the second in the lower. To each of the screws (10) is associated a plurality of control units, each indicated in the complex with (12), which, on each of the screws (10), are in equal number to the knife-counterknife assemblies to be moved. The screws (10) and operative members, which will be mentioned later, are supported by a support frame of the machine not shown. Cog-wheels (14) are keyed on the superimposed ends of the screws (10), which are interconnected by a chain (16) which makes it possible to transmit movement in synchronous way from the end of the upper screw (10) connected to a control motor (18) at the end of the lower screw (10). In this way the screws (10) will rotate in synchronism one with respect to the other. To each of the screws (10) is associated a slip beam (20) which extends in a direction parallel to the relative worm screw (10). Along the slip beam (20) slide the means of support of the knives (24) and counterknives (24*a*) of the machine. These means of support are shown in more detail in FIGS. 2 to 4. Each means of support comprises a compound bracket, indicated as a whole with (22), which is fixed from one side to the control unit (12), while, from the other side, it supports in known way the knife (24).

FIGS. 2 to 4 show only the knife (24), the means of support of the counterknife (24*a*) have an essentially identical structure and the counterknife is shaped in substantially similar manner to the knife (24), i.e. it is also of essentially circular shape. The shape of the compound bracket (22) and the movement of the knife (24) with respect to the counterknife to make the cut are not described in detail as they are made in traditional way.

The compound bracket (22) is equipped, on the side opposite that where the knife (24) is positioned, with small rollers (26) which can translate on the slip beams (20).

The control unit (12) according to the invention comprises a hollow body (30) inserted in the screw (10) and means of pneumatic or hydraulic type placed in the hollow of said body to control the movement of the means of support (22) to which the knife (24) and counterknife (24*a*) are connected. The hollow of the hollow body (30) has preferably the shape of a cylindrical chamber (28).

The abovementioned pneumatic means of each control unit (12), placed inside said cylindrical chamber (28) comprise a pair of essentially cylindrical bodies (32) placed on the opposite sides of the screw (10). Said cylindrical bodies (32) have the diameter at right angle to that of the screw (10), slide sealed in the chamber (28) by means of seal gaskets (34) and are shaped substantially like a head of a pneumatic piston without shank. Each of the cylindrical bodies (32) has the facing surface shaped to be engaged with a female screw, in particular a female screw with recycling of balls (36) in which the screw (10) can rotate. In the condition shown in FIG. 2, the cylindrical elements (32) are engaged with the female screw (36), locking its rotation; in this condition, as the screw (10) is always in rotation, the control unit (12) associated to this segment of female screw will consequently be made translate. The control unit (12) is driven by compressed air coming from a suitable feed source (not illustrated) which reaches the unit in the direction of the arrow F through a feed duct (38).

The compressed air is inserted in the chamber (28) through an inlet duct (40) to the first of the two cylindrical bodies (32), and, through a shunted duct (42) obtained in the body (30) of the control unit (12), to the second of the cylindrical bodies (32). In this way, through the insertion of compressed air in the chamber (28), the two cylindrical bodies (32) will be brought nearer to each other, so that they are engaged with the female screw (36) to lock their rotation and control its movement along the screw (10). FIG. 3 shows the control unit (12) in deactivated condition, in which the compressed air is no longer sent to the chamber (28) of the control unit (12). In this condition the cylindrical bodies (32) are released from the female screw (36), which, supported at opposite ends by bearings (35) placed in the body (30) can rotate with the screw (10) without causing displacement of the knives (24) or counterknives (24*a*). With particular reference to FIG. 1, the various control units (12) are fed by a pneumatic circuit comprising a feed duct (46) for each of the screws (10) on which is derived a plurality of feed ducts (38), on each of which an on-off valve (44) is inserted.

FIG. 5 illustrates a constructive variant of the control unit (12). In this form of construction, the control unit (12) comprises a suitably shaped piston which slides in the chamber of the hollow body (30).

The chamber presents an upper and lower part (53) of smaller diameter and a central part (48) of wider diameter. In the portion (48) with wider diameter, compressed air is inserted through the underlying feed duct (38) and inlet duct of the compressed air (40).

The piston comprises an intermediate portion (50) of larger diameter which slides with seal in the central part (48) of the chamber, and a portion (51, 56) of smaller diameter which slides with seal inside the chamber (53) of the body of the control unit (12). The portion with larger diameter (50) cooperates with a spring (54) wound round the body of the shank (52) of the piston and is engaged, at one end, with the portion with larger diameter (50) of the piston, and, with the other end, with the upper inside surface of the chamber. The free end of the portion (56) with smaller diameter is equipped with a stop tooth (58) suitable for engagement in a corresponding hollow (60) provided transversely on the section of the female screw (36).

This form of alternative construction operates as follows. When compressed air is not fed to the control unit (12), through the ducts (38) and (40), as shown in FIG. 5, the mobile piston of the unit is brought, by action of the spring (54), to the position shown in said FIG. 5 in which the tooth (58) is engaged in the hollow (60) of the female screw (36), locking its rotation. In this operative phase, the screw (10) being always in rotation (10), the nut screw (36) will cause a translation of the knife (24) or counterknife (24*a*) associated to it.

When compressed air is inserted in the chamber of larger diameter (48), the mobile piston of the control unit (12) is lifted from the previous position so that its stop tooth (58) will be released from the hollow (60) of the female screw (36). The latter does not therefore control the translation of the knife (24) or associated counterknife (24*a*). The means of drive described above of the control unit (12) which have been illustrated of pneumatic type could also be, according to a further final variant, of electromagnetic type. It would be sufficient for this purpose to substitute the means described above with a pair of magnets, the first integral to the cylindrical body (32) of the first form of implementation of FIGS. 2-4 or to the cylindrical body (50,51) of the final variant of FIG. 5, while the second could be integral to the second cylindrical body (32) of the first form of implementation and to the portion (56) of the mobile piston of the second form of implementation. While the invention has herein been illustrated by means of detailed embodiments, it will be appreciated that various substitutions of equivalents may be made without departing from the spirit and scope of the invention as set forth in the following claims.

I claim:

1. An apparatus for cutting a material in sheets form by means of a plurality of pairs of knives and counterknives (24, 24*a*) which comprises one upper screw and a lower screw (10), motor means (18) for rotating said upper and lower screw, arranged parallel to each other and spaced therebetween, a plurality of control units (12) associated with each said screw, in number equal to the pairs of knives and counterknives, a frame for supporting said screws, means for transmitting motion from one end of the upper screw to the lower screw whereby said screws rotate synchronously, a slip beam (20) associated with each screw and parallel thereto, support means (22) for supporting said knives and counterknives sliding on each said slip beam, said knives and counterknives being of essentially circular shape, said support means comprising a bracket having a first end and a second end fixed at the first end thereof to each of said control unit and at the second end to each knife or counterknife and being equipped at the first end with rollers (26), each control unit (12) comprising a hollow body (30) and forming a cylindrical chamber (28), said body being inserted in each of said upper or lower screw, and means of hydraulic or pneumatic type for placing in motion said support means (22) arranged within said cylindrical chamber on the side opposite said screw, said means for placing in motion said support means comprising a pair of cylindrical bodies (32) placed on opposite sides of each said screw, means (34) for slidably sealing said cylindrical bodies in said chamber, a female screw (36) located for engagement with said upper and lower screw whereby said upper lower screw rotate therein, each of said cylindrical bodies having the surface facing said female screw (36) capable of engaging with said female screw, whereby said upper and lower screw rotate, and when said cylindrical bodies are brought closer together, by the action of said pneumatic or hydraulic type, they engage said female screw and said female screw is locked and moves along each of said upper and lower screw and said knives and counterknives are displaced, and when said hydraulic or pneumatic means stop, said cylindrical bodies are released from said female screw, said female screw is free to rotate with each of said screws without displacement of said knives and counterknives.

2. The apparatus according to claim 1 which is provided with rotating bearings (35) located between said female screw and said hollow body.

3. An apparatus for cutting a material in sheet form by means of a plurality of pairs of knives and counterknives (24, 24*a*) which comprises one upper screw and a lower screw (10), motor means (18) for rotating said upper and lower screw, arranged parallel to each other and spaced therebetween, a plurality of control units (12) associated with each said screw, in number equal to the pairs of knives and counterknives, a frame for supporting said screws, means for transmitting motion from one end of the upper screw to the lower screw whereby said screws rotate synchronously, a slip beam (20) associated with each screw and parallel thereto, support means for supporting said knives and counterknives sliding on each said slip beam, said knives and counterknives being of essentially circular shape, said support means comprising a bracket having a first end and a second end, fixed at the first end thereof to each of said control unit and at the second end to each knife or counterknife and being equipped at the first end with rollers (26), each control unit comprising a hollow body, said body being inserted in each of said upper and lower screw, said hollow body forming an upper chamber, a lower chamber (53) and a central chamber (48), said upper and lower chamber being of smaller diameter than said central chamber, means for injecting compressed air into said central chamber, a piston sliding in said hollow body, said piston having an intermediate portion (50) sealingly sliding in said central chamber, and having a portion of smaller diameter (51,56) sealingly sliding within said upper and lower chambers of smaller diameter, a spring (54) located between said piston and the inner wall of said upper chamber (53) said piston having a shank (52), said spring having one end wound around shank and engaging the inner surface of said upper chamber, a stop tooth (58) at the lower end of said piston, pneumatic means for placing in motion said piston arranged within said hollow body, a female screw (36) located for engagement with said upper and lower screw and having a recess (60) whereby said upper and lower screws rotate therein, whereby when compressed air is injected in said central chamber (48), said piston is lifted, said stop tooth is released from said recess the female screw is free to rotate with each of said screws without displacement of said knives and counterknives and when the injection of compressed air is stopped, said spring causes said piston to be lowered, whereby said stop tooth seats in said recess (60), locks said female screw and said female screw moves along each of said upper and lower screws and causes translation of said knives and counterknives.

* * * * *